US012782056B2

(12) United States Patent
Eda et al.

(10) Patent No.: US 12,782,056 B2
(45) Date of Patent: Nov. 3, 2026

(54) AIR CONDITIONER HAVING PARALLEL-FLOW CONDENSER

(71) Applicant: UACJ Corporation, Tokyo (JP)

(72) Inventors: Hikaru Eda, Aichi (JP); Tomoaki Toyama, Aichi (JP); Sayo Fukada, Aichi (JP)

(73) Assignee: UACJ Corporation, Tokyo (JP)

( * ) Notice: Subject to any disclaimer, the term of this patent is extended or adjusted under 35 U.S.C. 154(b) by 187 days.

(21) Appl. No.: 18/702,850

(22) PCT Filed: Jan. 26, 2022

(86) PCT No.: PCT/JP2022/002855

§ 371 (c)(1),
(2) Date: Apr. 19, 2024

(87) PCT Pub. No.: WO2023/144917

PCT Pub. Date: Aug. 3, 2023

(65) Prior Publication Data

US 2024/0418448 A1 Dec. 19, 2024

(51) Int. Cl.

| | |
|---|---|
| ***F28D 1/02*** | (2006.01) |
| ***F28F 1/02*** | (2006.01) |
| ***F28F 9/02*** | (2006.01) |

(52) U.S. Cl.

CPC ..... *F28D 1/02* (2013.01); *F28F 1/02* (2013.01); *F28F 9/0246* (2013.01); *F28D 2001/026* (2013.01)

(58) Field of Classification Search

CPC ..... F28F 1/02; F28F 9/0246; F28F 21/084; F28F 2275/04; F28D 1/02; F28D 2001/026; F28D 1/05391

See application file for complete search history.

(56) References Cited

U.S. PATENT DOCUMENTS 11,022,372 B2 * 6/2021 Tada ..... F28D 1/05383
2013/0284415 A1 * 10/2013 Katoh ..... B60H 1/00321 165/175

(Continued)

FOREIGN PATENT DOCUMENTS

CN 104620069 B * 8/2016 ..... F24F 1/0067
FR 2776759 A1 10/1999

(Continued)

OTHER PUBLICATIONS

English translation of the Written Opinion of the International Searching Authority in parent application No. PCT/JP2022/002855.

(Continued)

*Primary Examiner* — Jon T. Schermerhorn, Jr.
(74) *Attorney, Agent, or Firm* — J-TEK LAW PLLC; Jeffrey D. Tekanic; Scott T. Wakeman

(57) ABSTRACT

A parallel-flow-type heat exchanger (1) includes a core (11) having flat, multi-hole pipes (2) arrayed in parallel with fins (3) interposed therebetween, the flat, multi-hole pipes and the fins being alternately stacked in an up-down direction. A first header (4) is disposed at one end of the core in a longitudinal direction of the flat, multi-hole pipes and a second header is disposed at the other end of the core in the longitudinal direction. The plurality of flat, multi-hole pipes is divided into at least a first group (21) having a first number of the flat, multi-hole pipes, which group is located most upward of the core, and a second group (22) having a second number of the flat, multi-hole pipes, which group is downward of and adjacent to the first group. The first number is 14 or more, and the second number is less than the first number.

20 Claims, 5 Drawing Sheets

(56) References Cited

U.S. PATENT DOCUMENTS

| | | | | |
|---|---|---|---|---|
| 2018/0306515 | A1* | 10/2018 | Tada | F28D 1/0417 |
| 2023/0147134 | A1* | 5/2023 | Nakao | F28F 1/22 165/173 |
| 2024/0219039 | A1* | 7/2024 | Onaka | F25B 1/00 |

FOREIGN PATENT DOCUMENTS

| | | | |
|---|---|---|---|
| JP | H0359364 | A | 3/1991 |
| JP | H09178299 | A | 7/1997 |
| JP | 2019035559 | A | 3/2019 |
| JP | 2019100568 | A | 6/2019 |

OTHER PUBLICATIONS

English translation of the International Search Report dated Apr. 5, 2022, in parent application No. PCT/JP2022/002855.

* cited by examiner

AIR CONDITIONER HAVING PARALLEL-FLOW CONDENSER

CROSS-REFERENCE

This application is the US national stage of International Patent Application No. PCT/JP2022/002855 filed on Jan. 26, 2022.

TECHNICAL FIELD

The present invention relates to a parallel-flow-type heat exchanger and to an air conditioner.

BACKGROUND ART

Air conditioners incorporate a condenser for condensing a coolant. A so-called parallel-flow-type heat exchanger comprising a core, which is constituted by alternately stacking flat, multi-hole pipes and corrugated fins, and headers, which are disposed at both end portions of the flat, multi-hole pipes of the core in the longitudinal direction, is widely used as the condenser.

As an example of this type of heat exchanger, a coolant condenser is described in Patent Document 1 and comprises: a plurality of tubes; corrugated fins, which are disposed between adjacent tubes; and tanks, which are connected to end portions of the tubes; wherein the plurality of tubes is divided into a plurality of tube groups by separators provided within the tanks, and a coolant flows through the plurality of tube groups.

In the past, this type of heat exchanger was configured such that the number of tubes belonging to the tube group located most upstream of the coolant flow was the greatest, and the number of tubes belonging to each of the tube groups was fewer the more downstream. The reason for this is as follows. It is known that the heat transfer coefficient and the pressure drop during a typical in-pipe condensation heat transfer is greatly affected by the mass velocity of the coolant and the quality (i.e., the degree of condensation) of the coolant. Specifically, there is a tendency that the lower the mass velocity of the coolant, the smaller the heat transfer coefficient and the lower the pressure drop during in-pipe condensation heat transfer. In addition, there is a tendency that the more that coolant condensation progresses and the lower the quality becomes, the smaller the heat transfer coefficient and the lower the pressure drop during in-pipe condensation heat transfer.

In the tube group located most upstream of the coolant condenser, coolant in the gas-phase state flows in and, while condensing within the tubes, flows out to the tube group on the downstream side. Consequently, in the tube group located most upstream of the coolant condenser, there is a tendency for the pressure drop also to become high even though the heat transfer coefficient becomes high. Accordingly, in a preexisting coolant condenser, by making the number of tubes belonging to the tube group located most upstream the greatest, a high heat transfer coefficient is achieved while curtailing an increase in the pressure drop due to the high-quality coolant.

On the other hand, in the tube groups more downstream than the tube group located most upstream, because condensation of the coolant is progressing, the heat transfer coefficient and the pressure drop are lower than in the tube group located most upstream. Consequently, in the preexisting coolant condenser, by making the number of tubes belonging to the tube groups smaller as the quality of the coolant becomes lower, optimization of the heat transfer coefficient and the pressure drop is achieved.

PRIOR ART LITERATURE

Patent Document

Patent Document 1

Japanese Laid-open Patent Application No. H3-59364

SUMMARY OF THE INVENTION

However, there is strong demand for a heat exchanger in which the amount of heat exchanged is even greater than that of the coolant condenser according to Patent Document 1.

It is one non-limiting object of the present teachings to disclose techniques for improving a parallel-flow-type heat exchanger, in which the amount of heat exchanged can be increased while curtailing an increase in the pressure drop, and for improving an air conditioner comprising such a heat exchanger.

Means for Solving the Problems

In one aspect of the present teachings, a parallel-flow-type heat exchanger may comprise:

- a core, in which a plurality of flat, multi-hole pipes configured such that a coolant can circulate therethrough is arranged in parallel with fins interposed therebetween and in which the flat, multi-hole pipes and the fins are stacked alternately in an up-down direction;
- a first header, which is disposed at one end of the core in a longitudinal direction of the flat, multi-hole pipes and is connected to the flat, multi-hole pipes; and
- a second header, which is disposed at the other end of the core in the longitudinal direction and is connected to the flat, multi-hole pipes;

wherein:

- the plurality of flat, multi-hole pipes is divided into a plurality of flat, multi-hole pipe groups, which include a first flat, multi-hole pipe group, which is located most upward of the core, and a second flat, multi-hole pipe group, which is downward of and adjacent to the first flat, multi-hole pipe group;
- the first header and the second header are configured such that the coolant can sequentially pass through the plurality of flat, multi-hole pipe groups from upward to downward;
- the number of the flat, multi-hole pipes belonging to the second flat, multi-hole pipe group is 14 or more; and
- the number of the flat, multi-hole pipes belonging to the first flat, multi-hole pipe group is less than the number of the flat, multi-hole pipes belonging to the second flat, multi-hole pipe group.

In another aspect of the present teachings, an air conditioner may comprise: the parallel-flow-type heat exchanger according to the above-mentioned aspect; and the coolant, which exists in the interior of the parallel-flow-type heat exchanger.

The core of the above-mentioned parallel-flow-type heat exchanger (hereinbelow, called a "heat exchanger") comprises the plurality of flat, multi-hole pipes, and the plurality of flat, multi-hole pipes is divided into the plurality of flat, multi-hole pipe groups, including the first flat, multi-hole pipe group, which is disposed most upward, and the second flat, multi-hole pipe group, which is disposed downward of and adjacent to the first flat, multi-hole pipe group. Furthermore, the number of the flat, multi-hole pipes belonging to the second flat, multi-hole pipe group is 14 or more, and the number of the flat, multi-hole pipes belonging to the first flat, multi-hole pipe group is less than the number of the flat, multi-hole pipes belonging to the second flat, multi-hole pipe group.

As described above, known condensers have been configured such that the number of tubes in upstream tube groups, through which high-quality coolant circulates, is greater than that of downstream tube groups, through which coolant of a quality that is lower to a certain degree circulates. However, as a result of diligent investigation by the present inventors, it was found that flat, multi-hole pipes have a characteristic heat-transfer property, in which, as condensation of the coolant progresses to a certain degree, the heat transfer coefficient no longer tends to affect the mass velocity of the coolant and the quality of the coolant. Utilizing this heat-transfer property, by making the number of the flat, multi-hole pipes belonging to the first flat, multi-hole pipe group less than the number of the flat, multi-hole pipes belonging to the second flat, multi-hole pipe group in a condenser, it becomes possible to increase the effect of enlarging the heat-exchanging surface area more than the effect of decreasing the heat transfer coefficient in the second flat, multi-hole pipe group, thereby increasing the amount of heat exchanged by the second flat, multi-hole pipe group.

Furthermore, the above-mentioned heat exchanger is configured such that the number of the flat, multi-hole pipes belonging to the first flat, multi-hole pipe group is less than the number of the flat, multi-hole pipes belonging to the second flat, multi-hole pipe group. For this reason, the above-mentioned heat exchanger can increase the amount of heat exchanged by the second flat, multi-hole pipe group while curtailing an increase in the pressure drop. As result, the amount of heat exchanged by the entire heat exchanger can be increased.

As described above, according to the heat exchanger of the above-mentioned aspect, the amount of heat exchanged can be increased while curtailing an increase in the pressure drop.

In addition, because the above-mentioned air conditioner comprises the heat exchanger according to the above-mentioned aspect, the amount of heat exchanged can be increased while curtailing an increase in the pressure drop of the heat exchanger.

DETAILED DESCRIPTION

Figure 1:
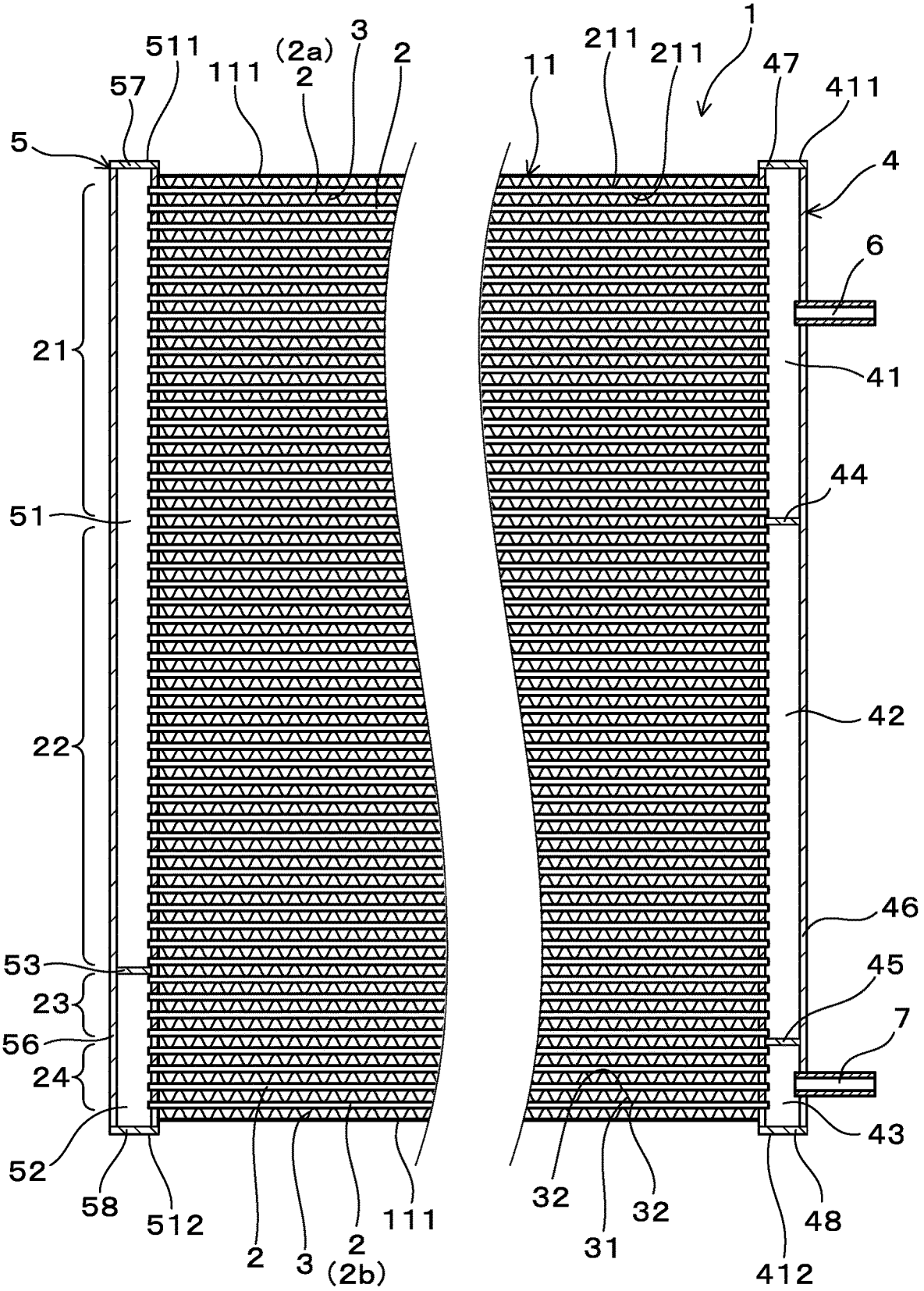
FIG. 1 is a cross-sectional view that shows the principal parts of a parallel-flow-type heat exchanger according to Working Example 1.

A core of the above-mentioned heat exchanger comprises a plurality of flat, multi-hole pipes. The total number of the flat, multi-hole pipes of the heat exchanger can be set as appropriate in accordance with the dimensions of the heat exchanger, the required rated capacity, the pressure drop, and the like. The total number of flat, multi-hole pipes may be, for example, 28 or more and 168 or less.

The plurality of flat, multi-hole pipes may be divided into a plurality of flat, multi-hole pipe groups, which include a first flat, multi-hole pipe group and a second flat, multi-hole pipe group. For example, the plurality of flat, multi-hole pipes in the above-mentioned heat exchanger may be divided into four flat, multi-hole pipe groups: a first flat, multi-hole pipe group, which is located most upward; a second flat, multi-hole pipe group, which is disposed downward of and proximate to the first flat, multi-hole pipe group; a third flat, multi-hole pipe group, which is disposed downward of and proximate to the second flat, multi-hole pipe group; and a fourth flat, multi-hole pipe group, which is disposed downward of and proximate to the third flat, multi-hole pipe group.

A first header and a second header are configured such that a coolant can be sequentially passed through, from above to below, the plurality of flat, multi-hole pipe groups. For example, in the situation in which the above-mentioned heat exchanger comprises four of the flat, multi-hole pipe groups, the first header and the second header may be configured such that the coolant can be sequentially passed through the first flat, multi-hole pipe group, the second flat, multi-hole pipe group, the third flat, multi-hole pipe group, and the fourth flat, multi-hole pipe group.

To implement such an aspect, for example, the interior space of the first header may be partitioned into three spaces: an inlet portion, which is connected to an end portion of the first flat, multi-hole pipe group; a second turn portion, which is connected to an end portion of the second flat, multi-hole pipe group and an end portion of the third flat, multi-hole pipe group; and an outlet portion, which is a connected to an end portion of the fourth flat, multi-hole pipe group; in addition, the interior space of the second header may be partitioned into two spaces: a first turn portion, which is connected to an end portion of the first flat, multi-hole pipe group and an end portion of the second flat, multi-hole pipe group; and a third turn portion, which is connected to an end portion of the third flat, multi-hole pipe group and an end portion of the fourth flat, multi-hole pipe group. In this situation, by supplying the coolant to the inlet portion of the first header, the coolant sequentially passes through the first flat, multi-hole pipe group, the first turn portion, the second flat, multi-hole pipe group, the second turn portion, the third flat, multi-hole pipe group, the third turn portion, and the fourth flat, multi-hole pipe group. Furthermore, by discharging the coolant via the outlet portion of the first header to the exterior of the heat exchanger, the coolant can be caused to circulate through the interior of the heat exchanger.

The number of flat, multi-hole pipes belonging to the second flat, multi-hole pipe group is 14 or more and is greater than or equal to the number of flat, multi-hole pipes belonging to the first flat, multi-hole pipe group. Thereby, the amount of heat exchanged when the coolant passes through the second flat, multi-hole pipe group can be increased and, in turn, the amount of heat exchanged by the entire heat exchanger can be increased. From the viewpoint of balancing the pressure drop of the heat exchanger and the amount of heat exchanged, the number of flat, multi-hole pipes belonging to the second flat, multi-hole pipe group preferably is greater than or equal to the number of flat, multi-hole pipes belonging to each of the flat, multi-hole pipe groups, other than the second flat, multi-hole pipe group.

Specifically, in the situation in which, for example, the heat exchanger comprises four of the flat, multi-hole pipe groups, the number of the flat, multi-hole pipes belonging to the second flat, multi-hole pipe group can be made to be 35% or more and 79% or less of the total number of the flat, multi-hole pipes of the heat exchanger, preferably can be made to be 35% or more and 75% or less, and more preferably can be made to be 35% or more and 60% or less.

The number of the flat, multi-hole pipes belonging to the first flat, multi-hole pipe group is less than the number of the flat, multi-hole pipes belonging to the second flat, multi-hole pipe group. Because the coolant that flows into the first flat, multi-hole pipe group is in the gas-phase state, i.e., a coolant having high quality, the heat transfer coefficient when the coolant passes through the first flat, multi-hole pipe group tends to become relatively high. In addition, in the situation in which the number of the flat, multi-hole pipes belonging to the first flat, multi-hole pipe group is made small, the mass velocity of the coolant increases as the heat-exchanging surface area decreases. For this reason, even if the number of the flat, multi-hole pipes belonging to the first flat, multi-hole pipe group is made to be less than the number of the flat, multi-hole pipes belonging to the second flat, multi-hole pipe group, a decrease in the amount of heat exchanged in the first flat, multi-hole pipe group can be curtailed. As a result, the amount of heat exchanged by the entire heat exchanger can be increased.

In the situation in which the above-mentioned heat exchanger comprises three or more of the flat, multi-hole pipe groups, the number of the flat, multi-hole pipes belonging to the first flat, multi-hole pipe group preferably is greater than the number of the flat, multi-hole pipes belonging to the third flat, multi-hole pipe group and to the flat, multi-hole pipe groups located more downward than the third flat, multi-hole pipe group. In this situation, the pressure drop when the coolant passes through the first flat, multi-hole pipe group can be further reduced, and the amount of heat exchanged can be further increased. As a result, the pressure drop of the entire heat exchanger can be further reduced, and the amount of heat exchanged by the entire heat exchanger can be further increased.

In addition, the above-mentioned heat exchanger is sometimes designed to exhibit heat-exchanging performance that excels when using a specific coolant. In such a situation, number $N_1$ [number] of the flat, multi-hole pipes belonging to the first flat, multi-hole pipe group more preferably satisfies the relation in equation (1) below.

$$N_1 > N \times 0.0014 \times \Delta P_{TP}^{0.48737} - 2 \quad (1)$$

Therein, N [number] in the above-mentioned equation (1) is the total number of the flat, multi-hole pipes of the heat exchanger. In addition, the value of $\Delta P_{TP}$ is the pressure drop of the heat exchanger. The value of $\Delta P_{TP}$ is calculated by equations (2)-(4) below, wherein the mass-flow rate of the above-mentioned coolant that flows through the interior of the above-mentioned parallel-flow-type heat exchanger is expressed as $m_{ref}$ [kg/s], the passageway, cross-sectional area of the above-mentioned flat, multi-hole pipe is expressed as $A_{tube}$ [$m^2$], the hydraulic diameter of the above-mentioned flat, multi-hole pipe is expressed as $D_h$ [m], the length of the above-mentioned flat, multi-hole pipe is expressed as $L_{tube}$ [m], the viscosity of the above-mentioned coolant in the liquid phase is expressed as $\mu_L$ [Pa·s], the viscosity of the above-mentioned coolant in the gas phase is expressed as $\mu_V$ [Pa·s], the density of the above-mentioned coolant in the liquid phase is expressed as $\rho_L$ [$kg/m^3$], and the density of the above-mentioned coolant in the gas phase is expressed as $\rho_V$ [$kg/m^3$].

$$\Delta P_{TP} = 0.0661 \times C_1 \times \Gamma^{-1.841} \quad (2)$$

$$C_1 = m_{ref}^{1.75} \times A_{tube}^{-1.75} \times D_h^{-0.75} \times \mu_L^{0.25} \times \rho_L^{-1} \times 4 \times L_{tube} \quad (3)$$

$$\Gamma = (\rho_V/\rho_L)^{0.5} \times \mu_L/\mu_V)^{0.125} \quad (4)$$

Thus, by making the number of the flat, multi-hole pipes belonging to the first flat, multi-hole pipe group to be within a range that considers the physical properties of the coolant, the balance between the amount of heat exchanged and the pressure drop of the first flat, multi-hole pipe group can be optimized. As a result, the pressure drop of the entire heat exchanger can be further reduced, and the amount of heat exchanged by the entire heat exchanger can be further increased.

It is noted that the above-mentioned equation (1) to equation (4) are determined based on the following approach. That is, as a result of the inventors investigating by trial and error using numerical analysis, it was found that the optimal number $N_1$ of the flat, multi-hole pipes belonging to the first flat, multi-hole pipe group varies greatly with the size of pressure drop $\Delta P_{TP}$ of the heat exchanger. Pressure drop $\Delta P_{TP}$ of the heat exchanger is considered to arise principally when the coolant passes through the flat, multi-hole pipes.

Assuming that the flow of the coolant within the flat, multi-hole pipes is a turbulent flow, pressure drop $\Delta P_{SP}$ when the coolant passes through the flat, multi-hole pipes is expressed by the Darcy-Weisbach equation (refer to equation (5) below).

Mathematical Equation 1

$$\Delta P_{SP} = 2f \frac{G^2}{D_h \rho_L} L_{tube} \quad (5)$$

In the above-mentioned equation (5), equation (6) below can be derived by using the Blasius pipe coefficient of friction as the pipe coefficient of friction f.

Mathematical Equation 2

$$\Delta P_{SP} = 2\left\{0.079\left(\frac{GD_h}{u_L}\right)^{-0.25}\right\}\frac{G^2}{D_h \rho_L} L_{tube} \quad (6)$$

Because G in the above-mentioned equation (6) can be expressed as $m_{ref}/A_{tube}$, the relation in equation (3') below can be derived by rearranging the above-mentioned equation (6).

$$\Delta P_{SP} \propto m_{ref}^{1.75} \times A_{tube}^{-1.75} \times D_h^{-0.75} \times \mu_L^{0.25} \times \rho_L^{-1} \times 4 \times L_{tube} \quad (3')$$

Based on the above, in expressing pressure drop $\Delta P_{TP}$ of the heat exchanger, it is understood that parameter C1 (above-mentioned equation (3)), which is related to pressure drop $\Delta P_{SP}$ when the coolant passes through the flat, multi-hole pipes, should be used.

In addition, the flow of the coolant through the interior of the heat exchanger is a gas-liquid, two-phase flow. For this reason, in calculating the size of pressure drop $\Delta P_{TP}$ of the heat exchanger, it is necessary to introduce not only the above-described parameter C1 but also Γ (above-mentioned equation (4)), which is a parameter for taking the effects of the gas-liquid, two-phase flow into consideration.

When the results of the numerical analysis performed by the inventors based on the above were rearranged, it was found that the optimal number $N_1'$ of the flat, multi-hole pipes belonging to the first flat, multi-hole pipe group can be approximated by equation (1') below, and pressure drop $\Delta P_{TP}$ of the heat exchanger can be approximated by the above-mentioned equation (2).

$$N_1' = N \times 0.0014 \times \Delta P_{TP}^{0.48737} \quad (1')$$

Furthermore, as will be explained in the working examples described below, the optimal number $N_1'$ of the flat, multi-hole pipes estimated by the above-mentioned equation (1') is greater by two at the maximum relative to the optimal number $N_1$ of the flat, multi-hole pipes derived by numerical analysis. Accordingly, the above-mentioned equation (1) can be derived by subtracting two from both sides of the above-mentioned equation (1') and leaving the left side as $N_1$.

In the situation in which the above-mentioned heat exchanger comprises three or more of the flat, multi-hole pipe groups, the number of the flat, multi-hole pipes belonging to the third flat, multi-hole pipe group and to the flat, multi-hole pipe groups located more downward than the third flat, multi-hole pipe group is not particularly limited. However, normally, the quality of the coolant that flows through the flat, multi-hole pipe groups located downward is less than or equal to the quality of the coolant that flows through the flat, multi-hole pipe groups located upward. For this reason, by making the number of the flat, multi-hole pipes belonging to the flat, multi-hole pipe groups located downward less than the number of the flat, multi-hole pipes belonging to the flat, multi-hole pipe groups located upward, the pressure drop of the entire heat exchanger can be further reduced, and the amount of heat exchanged by the entire heat exchanger can be further increased.

For example, in the situation in which the heat exchanger comprises four of the flat, multi-hole pipe groups, the number of the flat, multi-hole pipes belonging to the third flat, multi-hole pipe group can be made to be 5% or more and 21% or less of the total number of the flat, multi-hole pipes of the heat exchanger. From the viewpoint of balancing the pressure drop and the amount of heat exchanged, the number of the flat, multi-hole pipes belonging to the third flat, multi-hole pipe group preferably is made to be 7% or more and 17% or less of the total number of the flat, multi-hole pipes of the heat exchanger, and more preferably is made to be 9% or more and 14% or less.

Likewise, the number of the flat, multi-hole pipes belonging to the fourth flat, multi-hole pipe group can be made to be, for example, 4% or more and 14% or less of the total number of the flat, multi-hole pipes of the heat exchanger. From the viewpoint of balancing the pressure drop and the amount of heat exchanged, the number of the flat, multi-hole pipes belonging to the fourth flat, multi-hole pipe group preferably is made to be 6% or more and 12% or less of the total number of the flat, multi-hole pipes of the heat exchanger, and more preferably is made to be 6% or more and 10% or less.

Each of the flat, multi-hole pipes of the above-mentioned heat exchanger has: a pair of flat-wall portions, the flat-wall portions being disposed spaced apart and opposing each other; connecting-wall portions, which connect both ends of the flat-wall portions in the width direction to each other; and partition portions, which partition the interior space surrounded by the flat-wall portions and the connecting-wall portions into a plurality of coolant passageways. The shape of each of the coolant passageways in a cross section perpendicular to the longitudinal direction of the flat, multi-hole pipes can take on various forms, for example, circular, elliptical, oblong, semicircular, triangular, quadrangular, and the like, in a cross section perpendicular to the longitudinal direction of the flat, multi-hole pipe. The number of the coolant passageways in each of the flat, multi-hole pipes can be set as appropriate within the range of, for example, 4 or more and 20 or less.

In a cross section perpendicular to the longitudinal direction, each of the coolant passageways in the flat, multi-hole pipes preferably is noncircular, i.e., a shape that has an angled portion at one or more locations. By incorporating the flat, multi-hole pipes, each of which has such coolant passageways, in the second flat, multi-hole pipe group, a decrease in the heat transfer coefficient of the second flat, multi-hole pipe group can be further curtailed. As a result, the effect of increasing the amount of heat exchanged by the second flat, multi-hole pipe group can be further enhanced and, in turn, the amount of heat exchanged by the entire heat exchanger can be further increased. It is note that, for example, the noncircular cross-sectional shape described above includes shapes such as a semicircle, a triangle, a quadrilateral, and the like. From the viewpoint of further enhancing the functions and effects described above, each of the coolant passageways in the flat, multi-hole pipes more preferably is a shape in which the contour in a cross section perpendicular to the longitudinal direction is composed of only straight lines. Such a cross-sectional shape includes shapes such as, for example, a triangle, a quadrilateral, and the like.

Hydraulic diameter $D_h$ of the flat, multi-hole pipe can be set as appropriate within a range of, for example, 0.00032 m or more and 0.001 m or less. In this situation, the heat-transfer efficiency of each of the flat, multi-hole pipes can be further increased. It is noted that hydraulic diameter $D_h$ of the flat, multi-hole pipe described above is expressed by equation (7) below using passageway, cross-sectional area $A_{tube}$ [$m^2$] of the flat, multi-hole pipe and passageway, wet-edge length $S_{tube}$ [m] of the flat, multi-hole pipe.

$$D_h = 4 \times A_{tube}/S_{tube} \quad (7)$$

In addition, length $L_{tube}$ of the flat, multi-hole pipe can be set as appropriate within a range of 0.4 m or more and 0.9 m or less. In this situation, the heat-transfer efficiency of each of the flat, multi-hole pipes can be further increased.

In the situation in which the above-mentioned heat exchanger is configured to use R32 (i.e., difluoromethane) as the coolant, hydraulic diameter $D_h$ of the flat, multi-hole pipe preferably is 0.00032 m or more and 0.001 m or less, and length $L_{tube}$ preferably is 0.4 m or more and 0.9 m or less. The flat, multi-hole pipe having hydraulic diameter $D_h$ and length $L_{tube}$ within the above-mentioned specific ranges can achieve a heat-exchanging efficiency that excels in particular when R32 is used as the coolant. For this reason, flat, multi-hole pipes having hydraulic diameter $D_h$ and length $L_{tube}$ within the above-mentioned specific ranges are suited to a heat exchanger configured to use R32 as the coolant.

The above-mentioned heat exchanger may have a rated capacity of, for example, 2 KW or more and 12 kW or less. It is noted that the rated capacity of the heat exchanger described above is assigned the value of the rated cooling capacity obtained by the cooling-capacity test stipulated in JIS B8615-1:2013.

Applications of the above-mentioned heat exchanger are not particularly limited, and the above-mentioned heat exchanger may be configured to be used in an outdoor unit of a stationary-type air conditioner, for example, for home use, for business use, or the like. In addition, the above-mentioned heat exchanger may be configured to be used in, for example, a condenser of a vehicle air conditioner.

Figure 7:
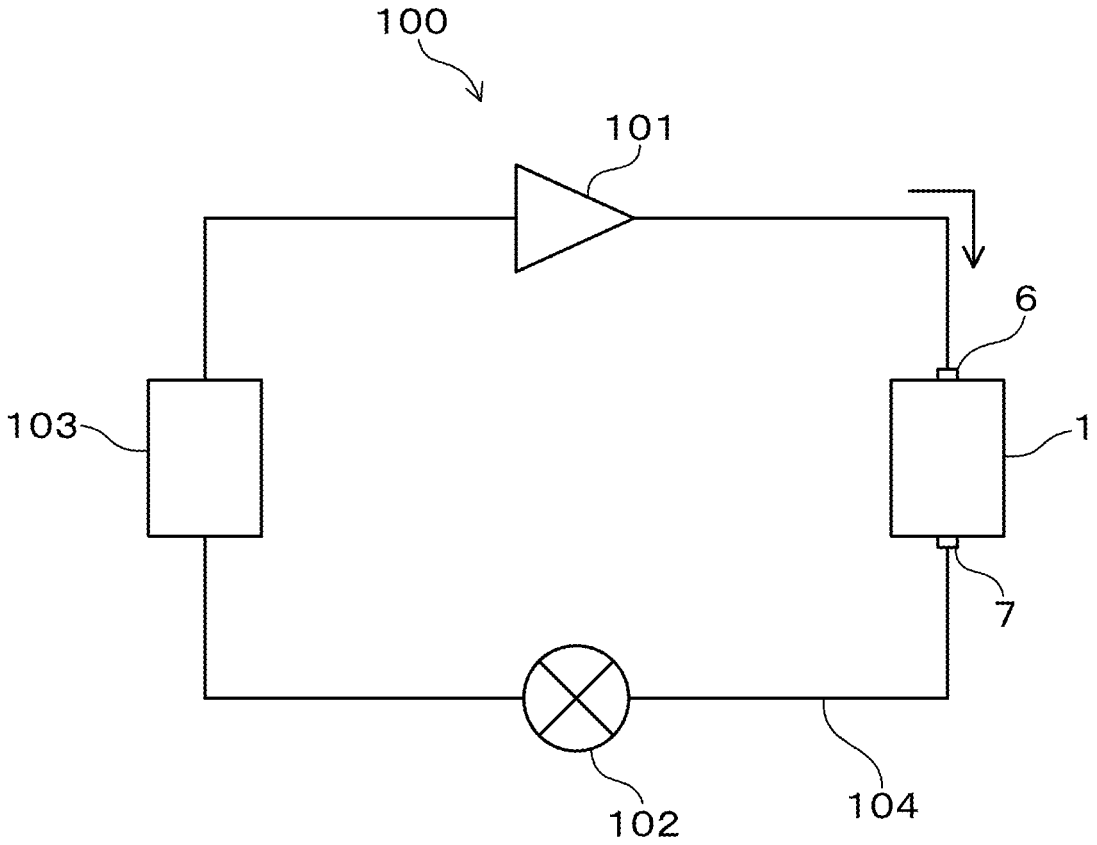
FIG. 7 shows an exemplary air conditioner according to the present teachings.

As shown in FIG. 7, an air conditioner 100 can be constituted by fluidly connecting the above-described condenser 1 to the component parts of an air conditioner, such as a compressor 101, an expansion valve 102, a pump, a heat exchanger other than the above-mentioned heat exchanger such as an evaporator 103, and the like, via coolant piping 104 and filling the interior thereof with the coolant.

The coolant used in the air conditioner is not particularly limited; for example, hydrofluorocarbon coolants such as R410A and R32, hydrofluoroolefin coolants, such as R1234yf and R1123, or the like can be used. The coolant used in the air conditioner preferably is R32. Because R32 has a comparatively large latent heat of condensation as well as high thermal conductivity, it is even easier to make the air conditioner compact and highly efficient.

The above-mentioned air conditioner preferably has a parallel-flow-type heat exchanger in which total number N [number] of the flat, multi-hole pipes and number $N_1$ [number] of the flat, multi-hole pipes belonging to the first flat, multi-hole pipe group satisfy the relation in the above-mentioned equation (1).

$$N_1 > N \times 0.0014 \times \Delta P_{TP}^{0.48737} - 2 \quad (1)$$

As described above, by making the number of the flat, multi-hole pipes belonging to the first flat, multi-hole pipe group within a range that takes the physical properties of the coolant into consideration, an increase in the pressure drop of the entire heat exchanger can be more effectively curtailed, and the amount of heat exchanged can be further increased. As a result, the energy consumption of the air conditioner can be further reduced.

The above-mentioned air conditioner may be configured such that mass-flow rate $m_{ref}$ of the above-mentioned coolant in the interior of the heat exchanger can be set within a range of, for example, 0.01 kg/s or more and 0.03333 kg/s or less. In this situation, an increase in the pressure drop of the above-mentioned heat exchanger can be more effectively curtailed, and the amount of heat exchanged by the above-mentioned heat exchanger can be further increased. As a result, the energy consumption of the air conditioner can be further reduced.

In particular, in the situation in which the coolant of the above-mentioned air conditioner is R32, by making mass-flow rate $m_{ref}$ of the above-mentioned coolant in the interior of the heat exchanger to be within a range of 0.01 kg/s or more and 0.03333 kg/s or less, the functions and effects described above can be more reliably exhibited.

From the same viewpoint, in the situation in which the coolant of the above-mentioned air conditioner is R32, it is particularly preferable for hydraulic diameter $D_h$ of the flat, multi-hole pipe in the heat exchanger to be within a range of 0.00032 m or more and 0.001 m or less, length $L_{tube}$ to be within a range of 0.4 m or more and 0.9 m or less, and mass-flow rate $m_{ref}$ of the coolant to be within a range of 0.01 kg/s or more and 0.03333 kg/s or less.

WORKING EXAMPLES

Working examples of the above-mentioned parallel-flow-type heat exchanger will now be explained.

Working Example 1

As shown in FIG. 1, a parallel-flow-type heat exchanger 1 of the present example comprises: a core 11, in which a plurality of flat, multi-hole pipes 2 through which the coolant circulates is arrayed in parallel with fins 3 interposed therebetween and the flat, multi-hole pipes 2 and the fins 3 are alternately stacked in the up-down direction; a first header 4, which is disposed at one end of the core 11 in the longitudinal direction of the flat, multi-hole pipes 2; and a second header 5, which is disposed at the other end of the core 11 in the longitudinal direction. The plurality of flat, multi-hole pipes 2 is divided into a plurality of flat, multi-hole pipe groups 21-24, which include a first flat, multi-hole pipe group 21, which is located most upward of the core 11, and a second flat, multi-hole pipe group 22, which is downward of and adjacent to the first flat, multi-hole pipe group 21.

The number of flat, multi-hole pipes 2 belonging to the second flat, multi-hole pipe group 22 is 14 or more. In addition, the number of the flat, multi-hole pipes 2 belonging to the first flat, multi-hole pipe group 21 is less than the number of the flat, multi-hole pipes 2 belonging to the second flat, multi-hole pipe group 22. The configuration of the heat exchanger 1 of the present example will be explained in greater detail below.

Each component that constitutes the heat exchanger 1 may be composed of an aluminum material (including aluminum and aluminum alloys). For example, the flat, multi-hole pipes 2 may be composed of a 1000-series aluminum or a 3000-series alloy. By using a 3000-series alloy as the material of the flat, multi-hole pipes 2, the coolant can be used at a higher pressure. The fins 3 may be composed of, for example, a 1000-series aluminum, a 3000-series alloy, or the like. In addition, the fins 3 may be constituted from a brazing sheet, in which a filler material composed of a 4000-series alloy is layered on both surfaces of a core material composed of a 1000-series aluminum, a 3000-series alloy, or the like.

The first header 4 and the second header 5 may be composed of a 1000-series aluminum, a 3000-series alloy, or the like. In addition, the first header 4 and the second header 5 may be constituted from a brazing sheet, in which a filler material composed of a 4000-series alloy is layered on both surfaces of a core material composed of a 1000-series aluminum, a 3000-series alloy, or the like.

As shown in FIG. 1, the core 11 of the heat exchanger 1 comprises: the plurality of flat, multi-hole pipes 2 disposed spaced apart in the up-down direction; and the fins 3, which are interposed between the flat, multi-hole pipes 2. The flat, multi-hole pipes 2 and the fins 3 are joined to each other by brazing. The core 11 of the present example further comprises side sheets 111, which are composed of an aluminum material. The side sheets 111 are joined, via the fins 3, to a flat, multi-hole pipe 2*a*, which is disposed at the upper-end flat, multi-hole pipe 2 of the plurality of flat, multi-hole pipes 2, and to a flat, multi-hole pipe 2*b*, which is disposed at the lower-end flat, multi-hole pipe 2 of the plurality of flat, multi-hole pipes 2.

The dimensions of the core 11 can be set as appropriate in accordance with the layout space or the like allowed in the desired heat exchanger, the air conditioner, or the like. Specifically, the outer dimension of the core 11 in the up-down direction, i.e., the outer dimension of the core 11 in the stacked direction, should be set as appropriate within a range of 250 mm or more and 1,500 mm or less. In addition, the outer dimension of the core 11 in the depth direction, i.e., the outer dimension of the flat, multi-hole pipe 2 in the width direction, should be set as appropriate within a range of 6 mm or more and 20 mm or less.

The outer dimension of the core in the width direction should be set in accordance with the desired effective length of each of the flat, multi-hole pipes 2, i.e., in accordance with the distance from the first header 4 to the second header 5 in the longitudinal direction of the flat, multi-hole pipes 2. The effective length of each of the flat, multi-hole pipes 2 can be set as appropriate within a range of, for example, 400 mm or more and 1,000 mm or less.

The total number of flat, multi-hole pipes 2 of the core 11 can be set as appropriate within a range of 28 or more and 168 or less. For example, in the present example, the total number of the flat, multi-hole pipes 2 of the core 11 can be made to be 52.

The flat, multi-hole pipes 2 in the heat exchanger 1 of the present example are divided into four flat, multi-hole pipe groups: the first flat, multi-hole pipe group 21 to the fourth flat, multi-hole pipe group 24. The first flat, multi-hole pipe group 21 is disposed most upward of the core 11. The second flat, multi-hole pipe group 22 is disposed downward of and adjacent to the first flat, multi-hole pipe group 21. The third flat, multi-hole pipe group 23 is disposed downward of and adjacent to the second flat, multi-hole pipe group 22. The fourth flat, multi-hole pipe group 24 is disposed downward of and adjacent to the third flat, multi-hole pipe group 23 and is located most downward in the core 11.

The interior space of the first header 4 is partitioned into three spaces: an inlet portion 41, which is connected to an end portion of the first flat, multi-hole pipe group 21; a second turn portion 42, which is connected to an end portion of the second flat, multi-hole pipe group 22 and an end portion of the third flat, multi-hole pipe group 23; and an outlet portion 43, which is connected to an end portion of the fourth flat, multi-hole pipe group 24. First partition sheets 44, 45, which partition these spaces, are provided between the inlet portion 41 and the second turn portion 42 and between the second turn portion 42 and the outlet portion 43.

The interior space of the second header 5 is partitioned into two spaces: a first turn portion 51, which is connected to an end portion of the first flat, multi-hole pipe group 21 and an end portion of the second flat, multi-hole pipe group 22; and a third turn portion 52, which is connected to an end portion of the third flat, multi-hole pipe group 23 and an end portion of the fourth flat, multi-hole pipe group 24. A second partition sheet 53, which partitions the two spaces, is provided between the first turn portion 51 and the third turn portion 52.

In addition, a coolant supply pipe 6 is configured to be capable of supplying compressed coolant into the heat exchanger (condenser) 1, e.g., by being fluidly connected to the compressor 101 (see FIG. 7), extends through a first wall portion of the first header 4 that defines in part (with first partition sheet 44) an inlet (volume) portion 41 (see FIG. 1), and is thus fluidly connected to the inlet portion 41 of the first header 4; in addition a coolant exhaust pipe 7 is configured to be capable of discharging condensed coolant inside the heat exchanger (condenser) 1 to the exterior, extends through a second wall portion of the first header 4 that defines in part (with first partition sheet 45) an outlet (volume) portion 43 (see FIG. 1), and thus fluidly connects the outlet portion 43 to the expansion valve 102 (see FIG. 7).

Therefore, the flow of the coolant in the heat exchanger (condenser) 1 of the present example is as follows. That is, the compressed coolant (e.g., from the compressor 101) that flows from the coolant supply pipe 6 into the inlet portion 41 is distributed, in the inlet portion 41, to each of the flat, multi-hole pipes 2 belonging to the first flat, multi-hole pipe group 21. The coolant that has passed through the first flat, multi-hole pipe group 21 then flows into the first turn portion 51 in the second header 5. The coolant that has merged in the first turn portion 51 is then distributed to each of the flat, multi-hole pipes 2 belonging to the second flat, multi-hole pipe group 22. The coolant that has passed through the second flat, multi-hole pipe group 22 subsequently passes sequentially through the second turn portion 42 in the first header 4, the third flat, multi-hole pipe group 23, the third turn portion 52 in the second header 5, and the fourth flat, multi-hole pipe group 24, and then flows into the outlet portion 43 of the first header 4. Thereafter, the condensed coolant that has merged in the outlet portion 43 is exhausted from the coolant exhaust pipe 7 to the exterior of the heat exchanger (condenser) 1 (e.g., to the expansion valve 102).

In the heat exchanger 1 of the present example, the number of the flat, multi-hole pipes 2 belonging to the flat, multi-hole pipe groups 21-24 should be set such that the number of the flat, multi-hole pipes 2 belonging to the second flat, multi-hole pipe group 22 is 14 or more, and the number of the flat, multi-hole pipes 2 belonging to the first flat, multi-hole pipe group 21 is less than the number of the flat, multi-hole pipes 2 belonging to the second flat, multi-hole pipe group 22.

For example, in the present example, as shown in FIG. 1, the number of the flat, multi-hole pipes 2 belonging to the first flat, multi-hole pipe group 21 can be made to be 19, the number of the flat, multi-hole pipes 2 belonging to the second flat, multi-hole pipe group 22 can be made to be 25, the number of the flat, multi-hole pipes 2 belonging to the third flat, multi-hole pipe group 23 can be made to be four, and the number of the flat, multi-hole pipes 2 belonging to the fourth flat, multi-hole pipe group 24 can be made to be four.

Figure 2:
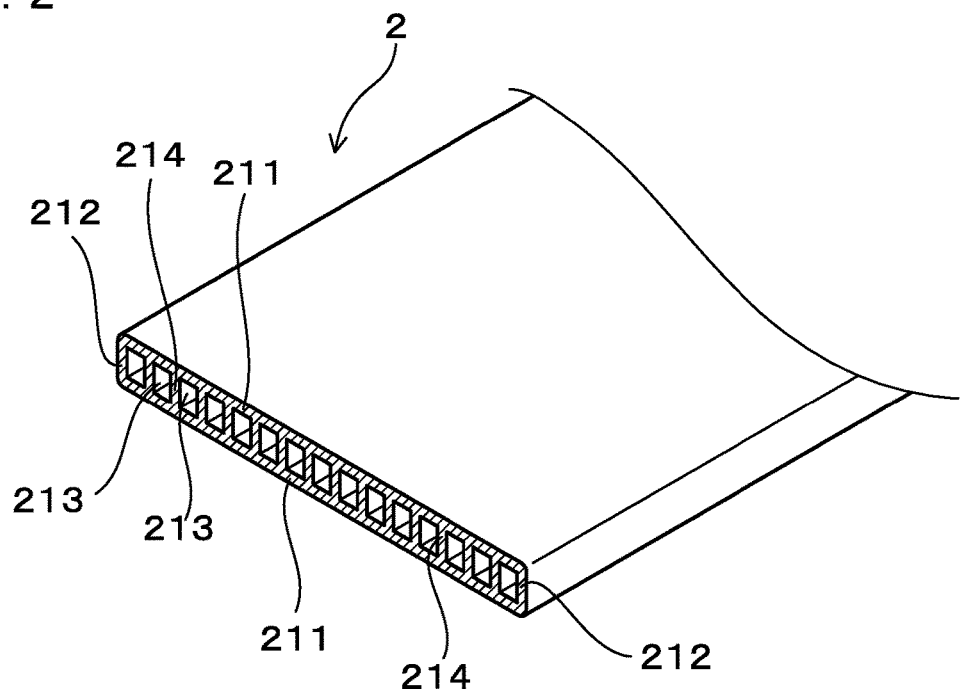
FIG. 2 is a cross-sectional view of a flat, multi-hole pipe according to Working Example 1.

As shown in FIG. 2, the flat, multi-hole pipe 2 of the present example exhibits a rectangular shape in a cross section perpendicular to the longitudinal direction. The outer dimensions of the flat, multi-hole pipe 2 can be set as appropriate, for example, within a range of 1.1 mm or more and 3.0 mm or less for the thickness and within a range of 6 mm or more and 20 mm or less for the width. For example, in the present example, the thickness of the flat, multi-hole pipe 2 can be made to be 1.15 mm, and the width of the flat, multi-hole pipe 2 can be made to be 13.85 mm.

Each of the flat, multi-hole pipes 2 has: a pair of flat-wall portions 211, the flat-wall portions 211 being disposed spaced apart and opposing each other; connecting-wall portions 212, which connect both ends of the flat-wall portions 211 in the width direction to each other; and partition portions 214, which partition the interior space surrounded by the flat-wall portions 211 and the connecting-wall portions 212 into a plurality of coolant passageways 213. Each of the flat, multi-hole pipes 2 may exhibit a rectangular shape, as shown in FIG. 2, in a cross section perpendicular to the longitudinal direction or, although not shown in the drawing, may exhibit an oblong shape. As shown in FIG. 1, the fins 3 are joined to the flat-wall portions 211 of the flat, multi-hole pipes 2.

The number of the coolant passageways 213 in each of the flat, multi-hole pipes 2 can be set as appropriate within a range of, for example, 4 or more and 20 or less. For example, in the present example, as shown in FIG. 2, the number of the coolant passageways 213 in each of the flat, multi-hole pipes 2 can be made to be 15. In addition, each of the coolant passageways 213 in the flat, multi-hole pipes 2 of the present example exhibits a rectangular shape in a cross section perpendicular to the longitudinal direction.

As shown in FIG. 1, corrugated fins can be used as the fins 3. The sheet thickness of each of the fins 3 can be made to be, for example, 0.06-0.12 mm. In addition, the height of each of the fins 3 in the up-down direction can be made to be 6-8 mm.

Louvers, which protrude from the fins 3 in the thickness direction, may be provided at flat portions 31 (refer to FIG. 1) of each of the fins 3, i.e., at portions between bent portions 32 joined to the flat, multi-hole pipes 2. The number of the louvers can be made to be 6-16 per one location of the flat portions 31. In addition, the louvers can extend in a direction tilted by 20°-60° relative to the width direction of the fins 3. It is noted that, in FIG. 1, the louvers are omitted for the sake of convenience.

The first header 4 comprises: a header main body 46, which exhibits a tube shape extending in the up-down direction, i.e., the stacked direction of the core 11; and caps 47, 48, which close up the upper end and the lower end of the header main body 46.

For example, although a circular-tube pipe having an outer diameter of 15-25 mm and a wall thickness of 1.0-2.5 mm can be used as the header main body 46, the header main body 46 is not limited to this shape. In addition, the caps 47, 48 and the first partition sheets 44, 45 are joined to the header main body 46 by brazing.

The interior space of the first header 4 surrounded by the header main body 46 and the caps 47, 48 is partitioned into three spaces by the two first partition sheets 44, 45. The portion from an upper end 411 of the first header 4 to the first partition sheet 44 disposed upward constitutes the inlet portion 41 of the first header 4. The end portions of the flat, multi-hole pipes 2 belonging to the first flat, multi-hole pipe group 21 are inserted into the inlet portion 41.

In addition, a coolant supply pipe 6, which is for supplying the coolant into the heat exchanger 1, is connected to the inlet portion 41. An end portion of the coolant supply pipe 6 is inserted into the inlet portion 41, and the coolant supply pipe 6 and the flat, multi-hole pipes 2 belonging to the first flat, multi-hole pipe group 21 communicate with each other via the inlet portion 41. Thereby, the inlet portion 41 is configured such that the coolant supplied from the coolant supply pipe 6 can be distributed to each of the flat, multi-hole pipes 2 belonging to the first flat, multi-hole pipe group 21.

In the first header 4, the portion from the first partition sheet 44, which is disposed upward, to the first partition sheet 45, which is disposed downward, constitutes the second turn portion 42. End portions of the flat, multi-hole pipes 2 belonging to the second flat, multi-hole pipe group 22 and the third flat, multi-hole pipe group 23 are inserted into the second turn portion 42. Thereby, the second turn portion 42 is configured to merge the coolant that has passed through the flat, multi-hole pipes 2 belonging to the second flat, multi-hole pipe group 22 and to be capable of distributing the coolant to the flat, multi-hole pipes 2 belonging to the third flat, multi-hole pipe group 23.

The portion from a lower end 412 of the first header 4 to the first partition sheet 45 disposed downward constitutes the outlet portion 43. The end portions of the flat, multi-hole pipes 2 belonging to the fourth flat, multi-hole pipe group 24 are inserted into the outlet portion 43.

In addition, the coolant exhaust pipe 7, which is for discharging the coolant in the heat exchanger 1 to the exterior, is connected to the outlet portion 43. An end portion of the coolant exhaust pipe 7 is inserted into the outlet portion 43, and the coolant exhaust pipe 7 and the flat, multi-hole pipes 2 belonging to the fourth flat, multi-hole pipe group 24 communicate with each other via the outlet portion 43. Thereby, the outlet portion 43 is configured to merge the coolant discharged from the flat, multi-hole pipes 2 belonging to the fourth flat, multi-hole pipe group 24 and to be capable of discharging the coolant to the exterior of the heat exchanger 1 via the coolant exhaust pipe 7.

The flat, multi-hole pipes 2, the coolant supply pipe 6, and the coolant exhaust pipe 7 inserted into the first header 4 are joined to the header main body 46 of the first header 4 by brazing.

The second header 5 comprises: a header main body 56, which exhibits a tube shape extending in the up-down direction, i.e., the stacked direction of the core 11; and caps 57, 58, which close up the upper end and the lower end of the header main body 56. In addition, the interior space of the second header 5 surrounded by the header main body 56 and the caps 57, 58 is partitioned into two spaces by the one second partition sheet 53.

Like the header main body 46 of the first header 4, for example, a circular-tube pipe having an outer diameter of 15-25 mm and a wall thickness of 1.0-2.5 mm can be used as the header main body 56, but the header main body 56 is not limited to this shape. In addition, the caps 57, 58 and the second partition sheet 53 are joined to the header main body 56 by brazing.

The portion from an upper end 511 of the second header 5 to the second partition sheet 53 constitutes the first turn portion 51. End portions of the flat, multi-hole pipes 2 belonging to the first flat, multi-hole pipe group 21 and the second flat, multi-hole pipe group 22 are inserted into the first turn portion 51. Thereby, the first turn portion 51 is configured to merge the coolant that has passed through the flat, multi-hole pipes 2 belonging to the first flat, multi-hole pipe group 21 and to be capable of distributing the coolant to the flat, multi-hole pipes 2 belonging to the second flat, multi-hole pipe group 22.

The portion from a lower end 512 of the second header 5 to the second partition sheet 53 constitutes the third turn portion 52. End portions of the flat, multi-hole pipes 2 belonging to the third flat, multi-hole pipe group 23 and the fourth flat, multi-hole pipe group 24 are inserted into the third turn portion 52. Thereby, the third turn portion 52 is configured to merge the coolant that has passed through the flat, multi-hole pipes 2 belonging to the third flat, multi-hole pipe group 23 and to be capable of distributing the coolant to the flat, multi-hole pipes 2 belonging to the fourth flat, multi-hole pipe group 24.

The flat, multi-hole pipes 2 inserted into the second header 5 are joined to the header main body 56 of the second header 5 by brazing.

The core 11 of the heat exchanger 1 of the present example comprises the plurality of flat, multi-hole pipe groups 21-24 and is configured such that the coolant flows sequentially to the first flat, multi-hole pipe group 21, the second flat, multi-hole pipe group 22, the third flat, multi-hole pipe group 23, and the fourth flat, multi-hole pipe group 24. In addition, the number of the flat, multi-hole pipes 2 belonging to the second flat, multi-hole pipe group 22 is 14 or more, and the number of the flat, multi-hole pipes 2 belonging to the first flat, multi-hole pipe group 21 is less than the number of the flat, multi-hole pipes 2 belonging to the second flat, multi-hole pipe group 22. For this reason, the heat exchanger 1 can increase the amount of heat exchanged by the second flat, multi-hole pipe group 22 while curtailing an increase in the pressure drop. As a result, the amount of heat exchanged by the entire heat exchanger 1 can be increased.

As a result of the above, according to the heat exchanger 1 of the present example, the amount of heat exchanged can be increased while curtailing an increase in the pressure drop.

Working Example 2

In the present example, two types of the heat exchangers 1 (Test Specimen A and Test Specimen B), in which the number of the flat, multi-hole pipes 2 belonging to each of the flat, multi-hole pipe groups 21-24 was modified, were prepared, and the amounts of heat exchanged by these heat exchangers 1 were evaluated. The specific configuration of each of the test specimens is explained below. It is noted that symbols used in examples subsequent to the present example that are identical to the symbols used in the previously discussed example indicate structural elements the same as the structural elements in the previously discussed example, unless otherwise described.

<Test Specimen A>

The basic shape of Test Specimen A was the same as that of the heat exchanger 1 of Working Example 1. The specific dimensions and the like of each part of Test Specimen A were as below.

Effective width: 664 mm

Outer dimension in the depth direction: 13.85 mm

Dimensions of the flat, multi-hole pipe 2: width: 13.85 mm, thickness: 1.15 mm Number of coolant passageways in the flat, multi-hole pipe 2: 15

Hydraulic diameter $D_h$ of the flat, multi-hole pipe 2: 0.530 mm

Passageway, cross-sectional area $A_{tube}$ of the flat, multi-hole pipe 2: 5.433 $mm^2$ Total number of the flat, multi-hole pipes 2: 52

Number of the flat, multi-hole pipes 2 belonging to the first flat, multi-hole pipe group 21: 19

Number of the flat, multi-hole pipes 2 belonging to the second flat, multi-hole pipe group 22: 25

Number of the flat, multi-hole pipes 2 belonging to the third flat, multi-hole pipe group 23: 4

Number of the flat, multi-hole pipes 2 belonging to the fourth flat, multi-hole pipe group 24: 4

Height of each of the fins 3: 7.61 mm

Pitch of the fins 3: 1.1 mm

It is noted that the effective width described above refers to the distance from the first header 4 to the second header 5 in the longitudinal direction of the flat, multi-hole pipes 2, i.e., substantially to the length of the portion at which heat exchange is performed between the flat, multi-hole pipes 2 and the outside air. In addition, the pitch of the fins 3 refers to the length of the period of the bent portions 32 of the fins 3.

<Test Specimen B>

Test Specimen B has the same configuration as Test Specimen A, except for the number of the flat, multi-hole pipes 2 belonging to each of the flat, multi-hole pipe groups 21-24 being modified as below.

The number of the flat, multi-hole pipes 2 belonging to the first flat, multi-hole pipe group 21: 22

The number of the flat, multi-hole pipes 2 belonging to the second flat, multi-hole pipe group 22: 15

The number of the flat, multi-hole pipes 2 belonging to the third flat, multi-hole pipe group 23: 10

The number of the flat, multi-hole pipes 2 belonging to the fourth flat, multi-hole pipe group 24: 5

Next, a method of measuring the amounts of heat exchanged by Test Specimen A and Test Specimen B will be explained. First, Test Specimen A and Test Specimen B were placed in a wind-tunnel apparatus, which was provided in a thermo-hygrostatic test chamber. Then, the air temperature inside the test chamber was set to a dry-bulb temperature of 35° C. and a wet-bulb temperature of 24° C., and air was blown from the wind-tunnel apparatus toward the condensers at one of the wind velocities listed in Table 1. Subsequently, R32, which served as the compressed coolant, was supplied into the coolant supply pipe 6 of each test specimen. It is noted that the condensation temperature of R32 is 45° C.

Then, the heat balance between the air and the coolant was measured while circulating the coolant such that the temperature of the coolant at the coolant supply pipe 6 became 65° C. (i.e., a degree of superheating of 20 K) and the temperature of the coolant at the coolant exhaust pipe 7 became 40° C. (i.e., a degree of supercooling of 5 K). The "Amount of Heat Exchanged" column in Table 1 lists the amount of heat exchanged at the point in time when the heat balance between the air and the coolant reached a steady state. In addition, the "Ratio" column in Table 1 lists, using a value expressed as a percentage (%), the ratio of the amount of heat exchanged by Test Specimen A relative to the amount of heat exchanged by Test Specimen B at each wind velocity.

TABLE 1

| | Wind Speed (m/s) | Amount of Heat Exchanged (kW) | Ratio (%) |
|---|---|---|---|
| Test Specimen A | 0.8 | 2.734 | 102.34 |
| | 1.2 | 3.915 | 102.84 |
| | 1.6 | 4.941 | 101.19 |
| Test Specimen B | 0.8 | 2.671 | — |
| | 1.2 | 3.807 | — |
| | 1.6 | 4.883 | — |

As listed in Table 1, compared with Test Specimen B, in which the number of the flat, multi-hole pipes 2 belonging to the second flat, multi-hole pipe group 22 was less than the number of the flat, multi-hole pipes 2 belonging to the first flat, multi-hole pipe group 21, Test Specimen A, in which the number of the flat, multi-hole pipes 2 belonging to the second flat, multi-hole pipe group 22 was greater than or equal to the number of the flat, multi-hole pipes 2 belonging to the other flat, multi-hole pipe groups 21, 23, 24, exhibited a greater amount of heat exchanged at every wind velocity.

Figure 3:
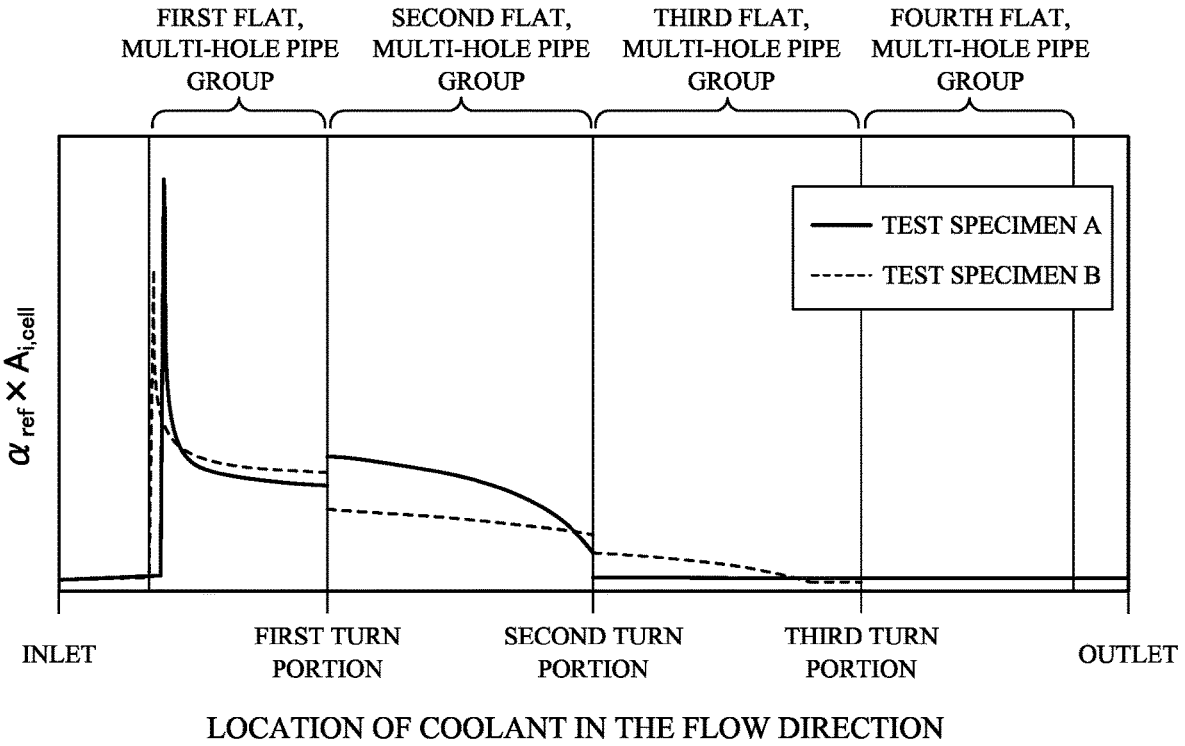
FIG. 3 is an explanatory diagram that schematically shows, for each test specimen in Working Example 2, the relationship between the location of the coolant in the flow direction and the amount of heat exchanged.

FIG. 3 is a drawing that schematically shows the relationship, for each test specimen, between the location of the coolant in the flow direction and the amount of heat exchanged. The ordinate in FIG. 3 is the product of the heat transfer coefficient $\alpha_{ref}$ between the flat, multi-hole pipes 2 and the coolant and the heat-exchanging surface area $A_{i,\ cell}$ between the flat, multi-hole pipes 2 and the coolant in each of the flat, multi-hole pipe groups 21-24. In addition, the abscissa in FIG. 3 is the location of the coolant in the flow direction for the situation in which the coolant supply pipe 6 serves as the reference. The product of $\alpha_{ref}$ and $A_{i,\ cell}$ is a value that becomes an indicator of the amount of heat exchanged; the larger the product of $\alpha_{ref}$ and $A_{i,\ cell}$, the greater the amount of heat that can be exchanged.

As shown in FIG. 3, when the coolant flows into Test Specimen A, first, an amount of heat is exchanged between the high-quality coolant and the air. Consequently, at the inlet of the first flat, multi-hole pipe group 21, the product of $\alpha_{ref}$ and $A_{i,\ cell}$ rises sharply because of the high heat transfer coefficient $\alpha_{ref}$ derived from the high-quality coolant. Then, the quality of the coolant gradually decreases as the coolant advances through the interior of the first flat, multi-hole pipe group 21. Attendant therewith, the product of $\alpha_{ref}$ and $A_{i,\ cell}$ gradually decreases as the coolant advances through the interior of the first flat, multi-hole pipe group 21.

On the other hand, in the second flat, multi-hole pipe group 22, the heat-exchanging surface area $A_{i,\ cell}$ with the coolant becomes large commensurate with the increase in the number of the flat, multi-hole pipes 2. Thereby, the product of $\alpha_{ref}$ and $A_{i,\ cell}$ can be made large. In addition, owing to the characteristic heat-transfer property described above, the flat, multi-hole pipes 2 can curtail a decrease in the heat transfer coefficient $\alpha_{ref}$ when the coolant, for which condensation has progressed to a certain extent, passes through. Consequently, by making the number of the flat, multi-hole pipes 2 belonging to the second flat, multi-hole pipe group 22 large, as shown in FIG. 3, the amount of heat exchanged by the second flat, multi-hole pipe group 22 can be further increased and, in turn, the amount of heat exchanged by the entire heat exchanger can be increased.

Working Example 3

In the present example, the number of the flat, multi-hole pipes 2 belonging to the first flat, multi-hole pipe group 21 was investigated. In the present example, to investigate the number of the flat, multi-hole pipes 2 belonging to the first flat, multi-hole pipe group 21, numerical analysis was performed using the analytical model below.

Figure 4:
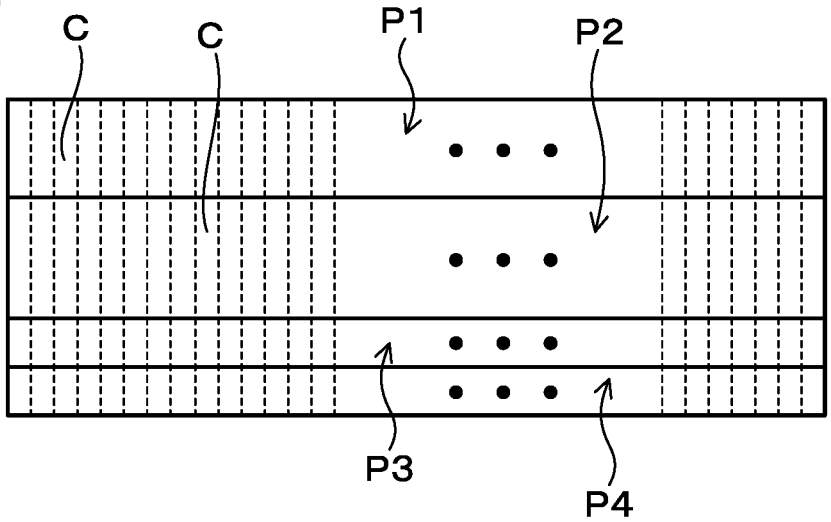
FIG. 4 is an explanatory diagram of an analytical model used in numerical analysis according to Working Example 2.
Figure 5:
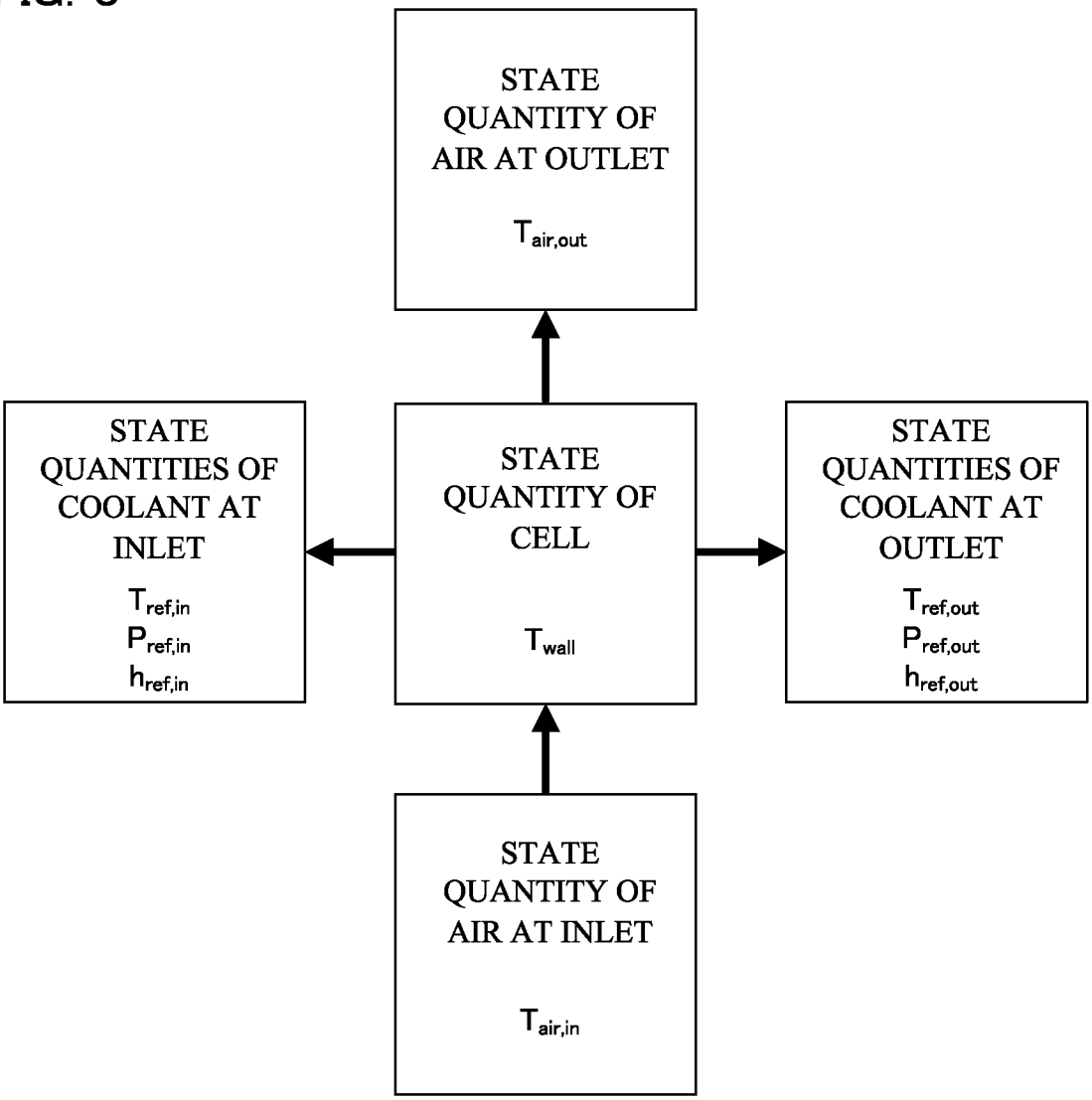
FIG. 5 is an explanatory diagram that schematically shows calculations performed by each cell in Working Example 2.

FIG. 4 and FIG. 5 show an outline of the analytical model. As schematically shown in FIG. 4, the analytical model has four coolant paths P1-P4, which correspond to the first flat, multi-hole pipe group 21 to the fourth flat, multi-hole pipe group 24. These coolant paths P1-P4 are divided into a plurality of calculation cells C in the longitudinal direction of the flat, multi-hole pipes 2. Furthermore, as schematically shown in FIG. 5, the amount of heat exchanged, the pressure drop, and the like of the entire heat exchanger can be calculated by sequentially performing, along the flow direction of the coolant, an operation that calculates, for each cell, state quantities of the coolant (temperature $T_{ref,\ out}$ [K], pressure $P_{ref,\ out}$ [Pa], and specific enthalpy $h_{ref,\ out}$ [kJ/kg]) and a state quantity of the air (temperature $T_{air,\ out}$ [K]) at the outlet based on state quantities of the coolant (temperature $T_{ref,\ in}$ [K], pressure $P_{ref,\ in}$ [Pa], and specific enthalpy $h_{ref,\ in}$ [KJ/kg]) and a state quantity of the air (temperature $T_{air,\ in}$ [K]) at the inlet.

The state quantities of the coolant at the outlet of each cell can be calculated by solving an energy-conservation equation and a conservation of momentum equation within each cell by iterative calculations. Specifically, the energy-conservation equation (refer to equation (8) below) between the air and the flat, multi-hole pipes 2 and the energy-conservation equation (refer to equation (10) below) between the flat, multi-hole pipes 2 and the coolant should be used in the calculation of temperature $T_{ref,\ out}$ and specific enthalpy $h_{ref,\ out}$ of the coolant at the outlet of each cell.

The energy-conservation equation on the air side at each cell can be expressed by equation (8) below.

$$\alpha_{air} \cdot LMTD \cdot A_{o,cell} = V_{air} \cdot A_{front,cell} \cdot \rho_{air} \cdot C_p(T_{air,out} - T_{air,in}) \tag{8}$$

The meanings of the symbols in the above-mentioned equation (8) are as below.

- $\alpha_{air}$: Heat transfer coefficient [W/(m$^2$·K)] between the air and the flat, multi-hole pipes 2 and between the air and the fins 3
- $A_{o,\ cell}$: Heat-exchanging surface area [m$^2$] between the flat, multi-hole pipes 2 and the air and between the fins 3 and the air for each cell
- $V_{air}$: Wind velocity [m/s] of the air that flows into the air inlet of each cell
- $A_{front,\ cell}$: Surface area [m$^2$] of the air inlet at each cell
- $\rho_{air}$: Density [kg/m$^3$] of the air
- $C_p$: Specific heat at constant pressure [J/(kg K)] of the air
- $T_{air,\ out}$: Temperature [K] of the air at the air outlet of each cell
- $T_{air,\ in}$: Temperature [K] of the air at the air inlet of each cell It is noted that wind velocity $V_{air}$ of the air that flows into the air inlet of each cell is a value calculated by dividing the volume-flow rate [m$^3$/s] of the air that flows into each cell by surface area $A_{front,\ cell}$ [m$^2$] of the air inlet of the cell.

In addition, symbol LMTD in the above-mentioned equation (8) is the logarithmic mean-temperature difference between the temperature of the coolant inlet/outlet at each cell and the temperature of the air inlet/outlet at each cell. The value of LMTD specifically can be calculated by equation (9) below, using wall-surface temperature $T_{wall}$ [K] of the flat, multi-hole pipes 2.

$$LMTD = (T_{air,out} - T_{air,in})/\log\{(T_{air,out} - T_{wall})/(T_{air,in} - T_{wall})\} \tag{9}$$

The energy-conservation equation on the coolant side of each cell can be expressed by equation (10) below.

$$\alpha_{ref} \cdot (T_{ref} - T_{wall}) \cdot A_{i,cell} = M_{ref} \cdot (h_{ref,in} - h_{ref,out}) \tag{10}$$

The meanings of the symbols in the above-mentioned equation (10) are as below.

$\alpha_{ref}$: Heat transfer coefficient [W/(m$^2$·K)] between the coolant and the flat, multi-hole pipes 2

$T_{ref}$: Temperature [K] of the coolant $A_{i,\ cell}$: Heat-exchanging surface area [m$^2$] between the coolant and the flat, multi-hole pipes 2 for each cell $M_{ref}$: Mass-flow rate [kg/s] of the coolant $h_{ref,\ in}$: Specific enthalpy of the coolant at the coolant inlet of each cell $h_{ref,\ out}$: Specific enthalpy of the coolant at the coolant outlet of each cell Because the amount of heat exchanged between the air and the flat, multi-hole pipes 2 and the amount of heat exchanged between the flat, multi-hole pipes 2 and the coolant are equal, the right side of the above-mentioned equation (8) and the right side of the above-mentioned equation (10) can be linked together by an equal sign. Thereby, equation (11) below can be obtained.

$$V_{air} \cdot A_{front,cell} \cdot \rho_{air} \cdot C_p(T_{air,out} - T_{air,in}) = M_{ref} \cdot (h_{ref,in} - h_{ref,out}) \quad (11)$$

Heat transfer coefficient $\alpha_{air}$ between the air and the flat, multi-hole pipes 2 in the above-mentioned equation (8) and heat transfer coefficient $\alpha_{ref}$ between the coolant and the flat, multi-hole pipes 2 in the above-mentioned equation (10) can be determined by separate calculations. In addition, in the situation in which a cell does not exist upstream of the cell that is the calculation object, properly set initial values should be used as the state quantities of the coolant at the inlet of each cell; and in the situation in which a cell does exist upstream of the cell that is the calculation object, the state quantities at the outlet of the upstream cell should be used. In addition, a properly set initial value should be used as the state quantity of the air at the inlet of each cell.

Accordingly, in the above-mentioned equation (8), equation (10), and equation (11), three unknown state quantities exist: temperature $T_{air,\ out}$ of the air at the air outlet of each cell; wall-surface temperature $T_{wall}$ of the flat, multi-hole pipes 2; and specific enthalpy $h_{ref,\ out}$ of the coolant at the coolant outlet. On the other hand, because the above-mentioned equation (8), equation (10), and equation (11) are conservation equations, these unknown state quantities can be determined by using an iterative method. Specifically, these unknown state quantities should be determined using a bisection method.

In addition, equation (12) below should be used as pressure $P_{ref,\ out}$ of the coolant at the coolant outlet of each cell.

$$P_{ref,out} = P_{ref,in} - \Delta P_f - \Delta P_m \quad (12)$$

Symbol $\Delta P_f$ in the above-mentioned equation (12) is the value of the pipe friction loss based on the Jige-Koyama equation, and $\Delta P_m$ is the pressure change associated with the phase change in the coolant. The value of the pressure change $\Delta P_m$ associated with the phase change in the coolant can be expressed by equation (13) below.

$$\Delta P_m = G^2 \cdot (1/\rho v - 1/\rho_L) \cdot (x_{ref,in} - x_{ref,out}) \quad (13)$$

It is noted that the meanings of the symbols in the above-mentioned equation (13) are as below.

G: Mass velocity [kg/(m$^2$·s)] of the coolant $x_{ref,\ in}$: Quality [−] of the coolant at the coolant inlet of each cell $x_{ref,\ out}$: Quality [−] of the coolant at the coolant outlet of each cell The validity of the above-mentioned analytical model can be confirmed by, for example, comparing the calculation results of the model that simulates Test Specimen A and Test Specimen B in Working Example 1 with the test results. Table 2 lists the calculation results of the model that simulates Test Specimen A and Test Specimen B.

TABLE 2

| | Wind Speed (m/s) | Amount of Heat Exchanged (kW) | Ratio (%) |
|---|---|---|---|
| Test Specimen A | 0.8 | 2.649 | 101.63 |
| | 1.2 | 3.750 | 100.89 |
| | 1.6 | 4.727 | 100.73 |
| Test Specimen B | 0.8 | 2.607 | — |
| | 1.2 | 3.717 | — |
| | 1.6 | 4.693 | — |

As listed in Table 2, the amount of heat exchanged by Test Specimen A, calculated by numerical analysis, is greater than the amount of heat exchanged of Test Specimen B at every wind velocity. In addition, the higher the wind velocity, the greater the amount of heat exchanged by Test Specimen A. Thus, the amount of heat exchanged calculated by the above-mentioned analytical model exhibits the same tendency as the test results. Based on these results, it can be understood that the above-mentioned analytical model is valid.

Next, a method of distributing the flat, multi-hole pipes 2, in which the amount of heat exchanged is the greatest for each of analysis conditions A-J listed in Table 3, will be investigated using the above-mentioned analytical model. It is noted that the structure of the analytical model, other than the values listed in Table 3, is as below.

Effective width: 700 mm

Outer dimension in the depth direction: 13.85 mm

Total number of the flat, multi-hole pipes 2: 52

Height of the fin 3: 7.61 mm

Pitch of the fins 3: 1.1 mm

Coolant: R32

Dry-bulb temperature of the air: 35° C.

Wet-bulb temperature of the air: 24° C.

Flat, multi-hole pipe A

- Dimensions: width of 13.85 mm and thickness of 1.15 mm
- Number of the coolant passageways: 15
- Hydraulic diameter $D_h$: 0.530 mm
- Passageway, cross-sectional area $A_{tube}$: 5.433 mm$^2$ Flat, multi-hole pipe B

- Dimensions: width of 13.85 mm and thickness of 1.93 mm
- Number of the coolant passageways: 13
- Hydraulic diameter $D_h$: 0.740 mm
- Passageway, cross-sectional area $A_{tube}$: 12.23 mm$^2$ Table 3 lists, for each of the analysis conditions A-J, the optimal value of the number of the flat, multi-hole pipes 2 belonging to the first flat, multi-hole pipe group 21. It is noted that, although not listed in the table, the optimal value of the number of the flat, multi-hole pipes 2 belonging to the second flat, multi-hole pipe group 22 for each of the analysis conditions A-J is greater than or equal to the optimal value of the number of the flat, multi-hole pipes 2 belonging to the first flat, multi-hole pipe group 21.

TABLE 3

| Condition | Condensing Temp. of Coolant (° C.) | Degree of Supercooling (K) | Wind Speed (m/s) | Mass Flow Rate of Coolant $m_{ref}$ (kg/s) | Flat, Multi-Hole Pipe Length $L_{tube}$ (mm) | Type | Optimal Number for First Flat, Multi-Hole Pipe Group [number] | Estimated Value According to Equation (1') [number] |
|---|---|---|---|---|---|---|---|---|
| A | 47 | 10 | 1.5 | 0.0181 | 727.5 | A | 15 | 14 |
| B | 50 | 8 | 1.5 | 0.0248 | 727.5 | A | 17 | 18 |
| C | 50 | 10 | 1 | 0.0171 | 727.5 | A | 14 | 13 |
| D | 50 | 10 | 1.5 | 0.0136 | 427.5 | A | 8 | 8 |
| E | 50 | 10 | 1.5 | 0.0239 | 727.5 | A | 17 | 17 |
| F | 50 | 10 | 1.5 | 0.0255 | 727.5 | B | 8 | 8 |
| G | 50 | 10 | 2 | 0.0298 | 727.5 | A | 20 | 20 |
| H | 50 | 12 | 1.5 | 0.0225 | 727.5 | A | 15 | 16 |
| I | 50 | 14 | 1.5 | 0.0198 | 727.5 | A | 14 | 15 |
| J | 53 | 10 | 1.5 | 0.0295 | 727.5 | A | 18 | 20 |

Figure 6:
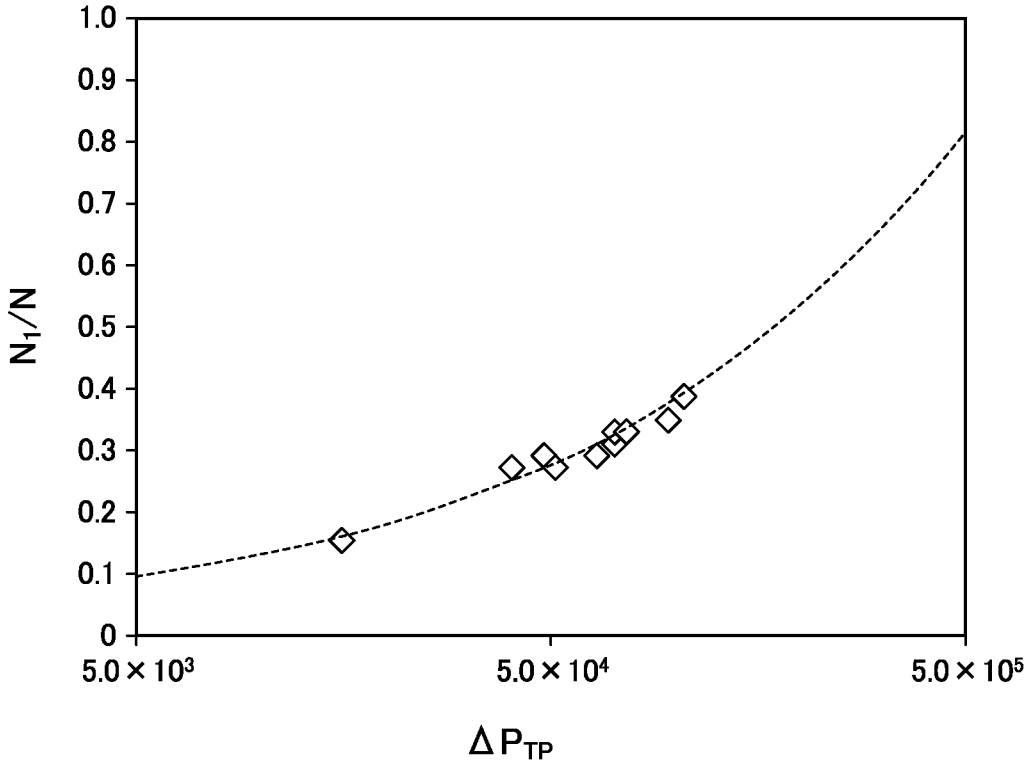
FIG. 6 is a graph that shows the optimal values for the number of the flat, multi-hole pipes belonging to a first flat, multi-hole pipe group according to Working Example 3.

In FIG. 6, a graph is shown in which ratio $N_1/N$ of the number $N_1$ [number] of the flat, multi-hole pipes belonging to the first flat, multi-hole pipe group relative to the total number N [number] of the flat, multi-hole pipes of the heat exchanger have been sorted according to the value of $\Delta P_{TP}$ in equation (2) below. In FIG. 6, the ordinate is the value of $N_1/N$, and the abscissa is the value of $\Delta P_{TP}$ in equation (2) below. In addition, the broken line in FIG. 6 is a curve expressed by equation (1') below. It is noted that the scale of the abscissa in FIG. 6 is a logarithmic scale.

$$\Delta P_{TP} = 0.0661 \times C_1 \times \Gamma^{-1.841} \quad (2)$$

$$N_1' = N \times 0.0014 \times \Delta P_{TP}^{0.48737} \quad (1')$$

Therein, the value of $\Delta P_{TP}$ in the above-mentioned equation (2) is the value calculated by equations (3)-(4) below, wherein: the mass-flow rate of the above-mentioned coolant that flows through the interior of the above-mentioned parallel-flow-type heat exchanger is expressed as $m_{ref}$ [kg/s]; the passageway, cross-sectional area of the above-mentioned flat, multi-hole pipe is expressed as $A_{tube}$ [$m^2$]; the hydraulic diameter of the above-mentioned flat, multi-hole pipe is expressed as $D_h$ [m]; the length of the above-mentioned flat, multi-hole pipe is expressed as $L_{tube}$ [m]; the viscosity of the above-mentioned coolant in the liquid phase is expressed as $\mu_L$ [Pa·s]; the viscosity of the above-mentioned coolant in the gas phase is expressed as $\mu_V$ [Pa·s]; the density of the above-mentioned coolant in the liquid phase is expressed as $\rho_L$ [$kg/m^3$]; and the density of the above-mentioned coolant in the gas phase is expressed as $\rho_V$ [$kg/m^3$].

$$C_1 = m_{ref}^{1.75} \times A_{tube}^{-1.75} \times D_h^{-0.75} \times \mu_L^{0.25} \times \rho_L^{-1} \times 4 \times L_{tube} \quad (3)$$

$$\Gamma = (\rho_V/\rho_L)^{0.5} \times (\mu_L/\mu_V)^{0.125} \quad (4)$$

According to the graph shown in FIG. 6, it can be understood that the curve expressed by the above-mentioned equation (1') well approximates, for each of analysis conditions A-J, the optimal value (number) of the flat, multi-hole pipes 2 belonging to the first flat, multi-hole pipe group 21. Accordingly, by using the above-mentioned equation (1'), the optimal value (number) of the flat, multi-hole pipes 2 belonging to the first flat, multi-hole pipe group 21 can be easily estimated.

In addition, the "Estimated Value According to Equation (1')" column in Table 3 lists the optimal values (number) of the flat, multi-hole pipes 2 belonging to the first flat, multi-hole pipe group 21 calculated by the above-mentioned equation (1'). According to these results, it can be understood that the value (number) estimated by the above-mentioned equation (1') is greater by two at the maximum relative to the optimal number of the flat, multi-hole pipes 2 belonging to the first flat, multi-hole pipe group 21 derived by numerical analysis.

Accordingly, by setting the lower limit of the number of the flat, multi-hole pipes 2 belonging to the first flat, multi-hole pipe group 21 to a number that is two fewer than the optimal value (number) of the flat, multi-hole pipes 2 belonging to the first flat, multi-hole pipe group 21 estimated by the above-mentioned equation (1'), the number of the flat, multi-hole pipes 2 belonging to the first flat, multi-hole pipe group 21 can be easily optimized, and the amount of heat exchanged by the entire heat exchanger can be further increased.

As described above, although a configuration example of the parallel-flow-type heat exchanger according to the present invention was explained based on Working Example 1 to Working Example 3, embodiments of the parallel-flow-type heat exchanger according to the present invention are not limited to the aspects recited in the working examples described above, and the configurations can be modified as appropriate within a scope that does not depart from the gist of the present invention.

The invention claimed is:

1. An air conditioner, comprising:

a parallel-flow-type condenser, and a coolant present in the interior of the parallel-flow-type condenser, wherein the parallel-flow-type condenser comprises:

a core, in which a plurality of flat, multi-hole pipes configured such that the coolant can circulate therethrough is arranged in parallel with fins interposed therebetween and in which the flat, multi-hole pipes and the fins are stacked alternately in an up-down direction;

a first header, which is disposed at a first longitudinal end of the core in a longitudinal direction of the flat, multi-hole pipes and is fluidly connected to first longitudinal ends of the flat, multi-hole pipes; and a second header, which is disposed at a second longitudinal end of the core in the longitudinal direction and is fluidly connected to second longitudinal ends of the flat, multi-hole pipes;

wherein:

the plurality of flat, multi-hole pipes is divided into a plurality of flat, multi-hole pipe groups, which include a first flat, multi-hole pipe group, which is located most upward of the core, a second flat, multi-hole pipe group, which is downward of and adjacent to the first flat, multi-hole pipe group; a third flat, multi-hole pipe group, which is downward of and adjacent to the second flat, multi-hole pipe group; and a fourth flat, multi-hole pipe group, which is downward of and adjacent to the third flat, multi-hole pipe group;

the first header and the second header are configured such that the coolant sequentially passes through the first, second, third and then fourth flat, multi-hole pipe groups from upward to downward;

the number of flat, multi-hole pipes belonging to the second flat, multi-hole pipe group is 14 or more; the number of flat, multi-hole pipes belonging to the first flat, multi-hole pipe group is less than the number of flat, multi-hole pipes belonging to the second flat, multi-hole pipe group; and the number of flat, multi-hole pipes belonging to the first flat, multi-hole pipe group is greater than the number of flat, multi-hole pipes belonging to the third flat, multi-hole pipe group and is also greater than the number of flat, multi-hole pipes belonging to the fourth flat, multi-hole pipe group.

2. The air conditioner according to claim 1, wherein:

the parallel-flow-type condenser is configured to use R32 as the coolant;

hydraulic diameter $D_h$ of the flat, multi-hole pipes is 0.00032 m or more and 0.001 m or less; and length $L_{tube}$ of the flat, multi-hole pipes is 0.4 m or more and 0.9 m or less.

3. The air conditioner according to claim 1, wherein the parallel-flow-type condenser has a rated capacity of 2 kW or more and 12 kW or less.

4. The air conditioner according to claim 1, wherein:

total number N [number] of the flat, multi-hole pipes of the air conditioner and number $N_1$ [number] of the flat, multi-hole pipes belonging to the first flat, multi-hole pipe group satisfy the relation in equation (1) below:

$$N_1 > N \times 0.0014 \times \Delta P_{TP}^{0.48737} - 2 \quad (1)$$

wherein the value of $\Delta P_{TP}$ in equation (1) is a value calculated using equations (2)-(4) below, in which the mass-flow rate of the coolant that flows through the interior of the parallel-flow-type condenser is expressed as $m_{ref}$ [kg/s], the passageway, cross-sectional area of the flat, multi-hole pipe is expressed as $A_{tube}$ [$m^2$], the hydraulic diameter of the flat, multi-hole pipe is expressed as $D_h$ [m], the length of the flat, multi-hole pipe is expressed as $L_{tube}$ [m], the viscosity of the coolant in the liquid phase is expressed as $\mu_L$ [Pa·s], the viscosity of the coolant in the gas phase is expressed as $\mu_V$ [Pa·s], the density of the coolant in the liquid phase is expressed as $\rho_L$ [kg/$m^3$], and the density of the coolant in the gas phase is expressed as $\rho_V$ [kg/$m^3$]:

$$\Delta P_{TP} = 0.0661 \times C_1 \times \Gamma^{-1.841} \quad (2)$$

$$C_1 = m_{ref}^{1.75} \times A_{tube}^{-1.75} \times D_h^{-0.75} \times \mu_L^{0.25} \times \rho_L^{-1} \times 4 \times L_{tube} \quad (3)$$

$$\Gamma = (\rho_V/\rho_L)^{0.5} \times (\mu_L/\mu_V)^{0.125}. \quad (4)$$

5. The air conditioner according to claim 4, wherein the coolant is R32.

6. The air conditioner according to claim 5, wherein the air conditioner is configured such that the mass-flow rate $m_{ref}$ of the coolant in the interior of the parallel-flow-type condenser is 0.01 kg/s or more and 0.03333 kg/s or less.

7. The air conditioner according to claim 6, wherein:

hydraulic diameter $D_h$ of the flat, multi-hole pipes is 0.00032 m or more and 0.001 m or less; and length $L_{tube}$ of the flat, multi-hole pipes is 0.4 m or more and 0.9 m or less.

8. The air conditioner according to claim 7, wherein the parallel-flow-type condenser has a rated capacity of 2 kW or more and 12 kW or less.

9. The air conditioner according to claim 1, wherein the coolant is R32.

10. The air conditioner according to claim 1, wherein the air conditioner is configured such that the mass-flow rate $m_{ref}$ of the coolant in the interior of the parallel-flow-type condenser is 0.01 kg/s or more and 0.03333 kg/s or less.

11. The air conditioner according to claim 1, wherein:

the first header includes two first partition sheets that partition an interior volume space of the first header into an inlet volume portion, a second turn volume portion and an outlet volume portion, the inlet volume portion fluidly connects the first longitudinal ends of the first flat, multi-hole pipe group, the second turn volume portion fluidly connects the first longitudinal ends of the second flat, multi-pipe group and the third flat, multi-pipe group, the outlet volume portion fluidly connects the first longitudinal ends of the fourth flat, multi-hole pipe group, the first header includes a second partition sheet that partitions an interior volume space of the second header into a first turn volume portion and a third turn volume portion, the first turn volume portion fluidly connects the second longitudinal ends of the first flat, multi-pipe group and the second flat, multi-pipe group, and the third turn volume portion fluidly connects the second longitudinal ends of the third flat, multi-pipe group and the fourth flat, multi-pipe group.

12. The air conditioner according to claim 11, further comprising:

a coolant inlet pipe that extends through a first wall portion of the first header that defines in part, together with one of the two first partition sheets, the inlet volume portion and is thus fluidly connected to the inlet volume portion, and a coolant outlet pipe that extends through a second wall portion of the first header that defines in part, together with the other of the two first partition sheets, the outlet volume portion and is thus fluidly connected to the outlet volume portion.

13. The air conditioner according to claim 12, further comprising:

a compressor fluidly connected to the coolant inlet pipe and configured to supply compressed coolant to the coolant inlet pipe; and an expansion valve fluidly connected to the coolant outlet pipe and configured to receive condensed coolant from the coolant outlet pipe.

14. The air conditioner according to claim 1, wherein:

the number of flat, multi-hole pipes belonging to the second flat, multi-hole pipe group is 35-79% of the total number of flat, multi-hole pipes of the condenser;

the number of flat, multi-hole pipes belonging to the third flat, multi-hole pipe group is 5-21% of the total number of flat, multi-hole pipes of the condenser; and the number of flat, multi-hole pipes belonging to the fourth flat, multi-hole pipe group is 4-14% of the total number of flat, multi-hole pipes of the condenser, with the proviso that the total number of flat, multi-hole pipes belonging to the first, second, third and fourth pipe groups amounts to 100%.

15. A method comprising:

operating the air conditioner according to claim 1 such that the mass-flow rate $m_{ref}$ of the coolant in the interior of the parallel-flow-type condenser is 0.01 kg/s or more and 0.03333 kg/s or less.

16. An air conditioner comprising:

a coolant; and a condenser that comprises:

a first number of flat, multi-hole pipes configured to circulate the coolant therethrough, the first number of the flat, multi-hole pipes extending in parallel to each other with fins respectively interposed therebetween such that the first number of flat, multi-hole pipes and the fins are stacked alternately in an up-down direction;

a second number of flat, multi-hole pipes configured to circulate the coolant therethrough, the second number of flat, multi-hole pipes extending in parallel to each other with fins respectively interposed therebetween such that the second number of flat, multi-hole pipes and the fins are stacked alternately in the up-down direction, the second number of the flat, multi-hole pipes being disposed below and adjacent to the first number of the flat, multi-hole pipes in the up-down direction;

a third number of flat, multi-hole pipes configured to circulate the coolant therethrough, the third number of flat, multi-hole pipes extending in parallel to each other with fins respectively interposed therebetween such that the third number of flat, multi-hole pipes and the fins are stacked alternately in the up-down direction, the third number of flat, multi-hole pipes being disposed below and adjacent to the second number of flat, multi-hole pipes in the up-down direction;

a fourth number of flat, multi-hole pipes configured to circulate the coolant therethrough, the fourth number of flat, multi-hole pipes extending in parallel to each other with fins respectively interposed therebetween such that the fourth number of flat, multi-hole pipes and the fins are stacked alternately in the up-down direction, the fourth number of flat, multi-hole pipes being disposed below and adjacent to the third number of the flat, multi-hole pipes in the up-down direction;

a first header fluidly connected to a first longitudinal end of each of the first, second, third and fourth numbers of flat, multi-hole pipes; and a second header fluidly connected to a second longitudinal end of each of the first, second, third and fourth numbers of the flat, multi-hole pipes;

wherein:

the first header and the second header are configured such that the coolant sequentially passes through the first number of flat, multi-hole pipes, then through the second number of flat, multi-hole pipes, then through the third number of flat, multi-hole pipes and finally through the fourth number of flat, multi-hole pipes from upward to downward in the up-down direction;

the second number is 14 or more;

the first number is less than the second number; and the first number is greater than the third number and is also greater than the fourth number.

17. The air conditioner according to claim 16, further comprising:

a compressor fluidly connected to a coolant inlet pipe that extends through a first wall portion of the first header, the compressor being configured to supply compressed coolant to the coolant inlet pipe; and an expansion valve fluidly connected to a coolant outlet pipe that extends through a second wall portion of the first header, the expansion valve being configured to receive condensed coolant from the coolant outlet pipe.

18. The air conditioner according to claim 17, wherein:

the first header includes two first partition sheets that partition an interior volume space of the first header into an inlet volume portion, a second turn volume portion and an outlet volume portion, the inlet volume portion fluidly connects the first longitudinal ends of the first flat, multi-hole pipe group, the second turn volume portion fluidly connects the first longitudinal ends of the second flat, multi-pipe group and the third flat, multi-pipe group, the outlet volume portion fluidly connects the first longitudinal ends of the fourth flat, multi-hole pipe group, the first header includes a second partition sheet that partitions an interior volume space of the second header into a first turn volume portion and a third turn volume portion, the first turn volume portion fluidly connects the second longitudinal ends of the first flat, multi-pipe group and the second flat, multi-pipe group, the third turn volume portion fluidly connects the second longitudinal ends of the third flat, multi-pipe group and the fourth flat, multi-pipe group, the first wall portion of the first header defines in part, together with one of the two first partition sheets, the inlet volume portion and thus the coolant inlet pipe is fluidly connected to the inlet volume portion, and the second wall portion of the first header defines in part, together with the other of the two first partition sheets, the outlet volume portion and thus the coolant outlet pipe is fluidly connected to the outlet volume portion.

19. The air conditioner method according to claim 15, wherein:

total number N [number] of the flat, multi-hole pipes of the parallel-flow-type condenser and number $N_1$ [number] of the flat, multi-hole pipes belonging to the first flat, multi-hole pipe group satisfy the relation in equation (1) below:

$$N_1 > N \times 0.0014 \times \Delta P_{TP}^{0.48737} - 2 \quad (1)$$

wherein the value of $\Delta P_{TP}$ in equation (1) is a value calculated using equations (2)-(4) below, in which the mass-flow rate of the coolant that flows through the interior of the parallel-flow-type condenser is expressed as $m_{ref}$ [kg/s], the passageway, cross-sectional area of the flat, multi-hole pipe is expressed as $A_{tube}$ [$m^2$], the hydraulic diameter of the flat, multi-hole pipe is expressed as $D_h$ [m], the length of the flat, multi-hole pipe is expressed as $L_{tube}$ [m], the viscosity of the coolant in the liquid phase is expressed as $\mu_L$ [Pa·s], the viscosity of the coolant in the gas phase is expressed as $\mu_V$ [Pa·s], the density of the coolant in the liquid phase is expressed as $\rho_L$ [$kg/m^3$], and the density of the coolant in the gas phase is expressed as $\rho_V$ [$kg/m^3$]:

$$\Delta P_{TP} = 0.0661 \times C_1 \times \Gamma^{-1.841} \tag{2}$$

$$C_1 = m_{ref}^{1.75} \times A_{tube}^{-1.75} \times D_h^{-0.75} \times \mu_L^{0.25} \times \rho_L^{-1} \times 4 \times L_{tube} \tag{3}$$

$$\Gamma = (\rho_V/\rho_L)^{0.5} \times (\mu_L/\mu_V)^{0.125}. \tag{4}$$

20. The method according to claim 19, wherein the coolant is R32.

* * * * *